US005307777A

United States Patent [19]

Sasajima et al.

[11] Patent Number: 5,307,777

[45] Date of Patent: May 3, 1994

[54] THROTTLE OPENING CONTROL SYSTEM FOR AUTOMOTIVE ENGINE

[75] Inventors: Kouji Sasajima, Tokyo; Takamichi Shimada, Sakado, both of Japan

[73] Assignee: Honda Giken Kogyo Kabushiki Kaisha, Tokyo, Japan

[21] Appl. No.: 59,146

[22] Filed: May 7, 1993

[30] Foreign Application Priority Data

May 12, 1992 [JP] Japan ..... 4-146667

[51] Int. Cl.[5] ..... F02D 11/10

[52] U.S. Cl. ..... 123/399

[58] Field of Search ..... 123/339, 350, 352, 361, 123/399

[56] References Cited

U.S. PATENT DOCUMENTS

| | | | |
|---|---|---|---|
| 4,335,694 | 6/1982 | Mausner et al. | 123/399 X |
| 4,625,690 | 12/1986 | Morita | 123/399 X |
| 4,727,838 | 3/1988 | Oshiage et al. | 123/399 X |
| 4,765,295 | 8/1988 | Ishikawa et al: | 123/399 |
| 4,765,296 | 8/1988 | Ishikawa et al. | 123/399 |
| 4,919,096 | 4/1990 | Manaka et al. | 123/399 |
| 5,003,948 | 4/1991 | Churchill et al. | 123/399 X |
| 5,078,109 | 1/1992 | Yoshida et al. | 123/399 X |
| 5,233,958 | 8/1993 | Knoss et al. | 123/399 X |

FOREIGN PATENT DOCUMENTS

| | | |
|---|---|---|
| 60-35141 | 2/1985 | Japan . |
| 2-37133 | 2/1990 | Japan . |

*Primary Examiner*—Willis R. Wolfe
*Attorney, Agent, or Firm*—Lyon & Lyon

[57] ABSTRACT

A control system for controlling the throttle opening of an engine of an automobile has a stepping motor for actuating a throttle valve disposed in an intake passage of the engine to control the throttle opening, an accelerator operation detecting unit for detecting the amount of operation of an accelerator pedal operated on by the driver of the automobile, an engine operating condition detecting unit for detecting an operating condition of the engine, and a controller for controlling the stepping motor based on detected values from the accelerator operation detecting unit and the engine operating condition detecting unit.

6 Claims, 7 Drawing Sheets

THROTTLE OPENING CONTROL SYSTEM FOR AUTOMOTIVE ENGINE

BACKGROUND OF THE INVENTION

1. Field of the Invention

The present invention relates to a system for controlling the throttle opening of an automotive engine, and more particularly to a control system for angularly moving a throttle valve with a stepping motor to control the opening of the throttle valve.

2. Description of the Prior Art

Generally, a throttle valve and an accelerator pedal on an automobile are operatively interconnected by a link and a cable. When the accelerator pedal is depressed by the driver of the automobile, the throttle valve is actuated, and its opening is controlled by the accelerator pedal.

Another known throttle opening control system employs a stepping motor coupled to a throttle valve. The stepping motor is controlled depending on the depression of an accelerator pedal and engine operating conditions for throttle opening control. One such throttle opening control system is disclosed in Japanese laid-open patent publication No. 60-35141, for example.

According to the disclosed system, a control value is calculated at predetermined periodic intervals according to the accelerator pedal depression and engine operating conditions, and a number of command pulses for rotating the stepping motor are issued in each of the periods to actuate the throttle valve.

The disclosed system has a problem in that the timing to output command pulses for controlling the stepping motor is not definite, and a next command pulse may be outputted while the stepping motor is being rotated by previous command pulses. Usually, the present angular position of the stepping motor, i.e., the present throttle opening, can be detected by counting the number of command pulses that have been outputted. If a next command pulse is issued while the stepping motor is being rotated, however, it is difficult to accurately detect the present angular position of the stepping motor even by counting the number of outputted command pulses. To solve this problem, it is necessary to use a position detector and feed back detected positional information.

It has been proposed in Japanese laid-open patent publication No. 2-37133 to calculate command pulses to be applied to a stepping motor in each calculation period, limit the number of command pulses to a number that can be outputted in a next calculation period, and output the limited number of command pulses at an initial stage of the next calculation period.

The proposed process is effective to prevent a next command pulse from being outputted while the stepping motor is being energized, and allow the angular position of the stepping motor to be detected based on the outputted command pulses. Therefore, the throttle opening can be determined only based on the outputted command pulses, making a position detector unnecessary and simplifying the control system.

Stepping motors suffer mechanical resonance at a certain frequency due to their structures. As shown in FIG. 8 of the accompanying drawings, when the frequency f of command pulses applied to a stepping motor agrees with a resonant frequency fl, the stepping motor loses steps, and its torque T sharply drops. To prevent the stepping motor from losing steps, the interval of command pulses is selected such that the frequency f of the command pulses differs from the resonant frequency fl.

As described above, the interval of command pulses is selected such that the frequency f of the command pulses differs from the resonant frequency fl. In the case where command pulses are calculated in each calculation period and outputted at an initial stage of a next calculation period, however, no control is effected over the time duration from the completion of outputting of command pulses in a calculation period to the start of outputting of next command pulses in a next calculation period. The time duration is equal to the difference between the length of a calculation period and a time required to output command pulses within the calculation period, and varies with the number of command pulses. Therefore, the frequency corresponding to the time duration may agree with the resonant frequency of the stepping motor. When the frequency corresponding to the time duration agrees with the resonant frequency, the stepping motor may lose steps and hence not be controlled satisfactorily.

SUMMARY OF THE INVENTION

It is an object of the present invention to provide a control system for controlling a stepping motor while preventing the stepping motor from losing steps.

Another object of the present invention is to provide a control system for accurately controlling the throttle opening of an automotive engine with a stepping motor while preventing the stepping motor from losing steps.

Still another object of the present invention is to provide a control system for preventing a stepping motor from losing steps due to the time duration from a certain command pulse to a next command pulse which corresponds to the resonant frequency of the stepping motor when command pulses for energizing the stepping motor are outputted in each calculation period.

To achieve the above object, there is provided in accordance with the present invention, as shown in FIG. 1, a throttle opening control system comprising accelerator operation detecting means a for detecting the amount of operation (e.g., the amount of depression) of accelerator means such as an accelerator pedal, engine operating condition detecting means b for detecting an engine operating condition, and a controller c for controlling a stepping motor g to control the throttle opening of a throttle valve h based on detected values from the accelerator operation detecting means a and the engine operating condition detecting means b.

The controller c comprises target throttle opening setting means d for setting a target throttle opening based on the detected values from the accelerator operation detecting means b, basic command pulse calculating means e for calculating in each calculation period command pulses to be applied to the stepping motor g which are required to equalize an actual throttle opening with the target throttle opening, and corrected command pulse calculating means f for calculating a time interval from the completion of outputting of calculated command pulses which have been outputted from the start of a next calculation period, to the end of the calculation period, and correcting the command pulses such that if the calculated time interval is of a value within a predetermined time range in which the stepping motor would lose steps, then the calculated time interval is corrected into a value outside the predetermined time range. The command pulses corrected by the corrected command pulse calculating means f and determined in each calculation period are outputted at an initial stage of each calculation period to control the stepping motor g for controlling the throttle opening.

To control the throttle opening with the throttle opening control system, a target throttle opening is established based on the detected values from the accelerator operation detecting means a and the engine operating condition detecting means b, and then command pulses to be applied to the stepping motor g which are required to equalize an actual throttle opening with the target throttle opening are calculated in each calculation period. Thereafter, a time interval from the completion of outputting of calculated command pulses which have been outputted from the start of a next calculation period, to the end of the calculation period, is calculated. Specifically, a time interval from a final pulse of the command pulses to a first pulse of next command pulses is calculated.

Then, it is determined whether the calculated time interval is of a value within the predetermined time range in which the stepping motor would lose steps. If the calculated time interval is of a value within the predetermined time range, then the command pulses are corrected such that the calculated time interval is corrected into a value outside the predetermined time range. The corrected command pulses are outputted at an initial stage of the next calculation period. The predetermined time range is a time range corresponding to a resonant frequency range in which the stepping motor would lose steps. When the command pulses are thus corrected, the frequency from the final pulse of the command pulses to the first pulse of the next command pulses is prevented from being of a value equal or close to the resonant frequency, so that the stepping motor is reliably prevented from losing steps.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
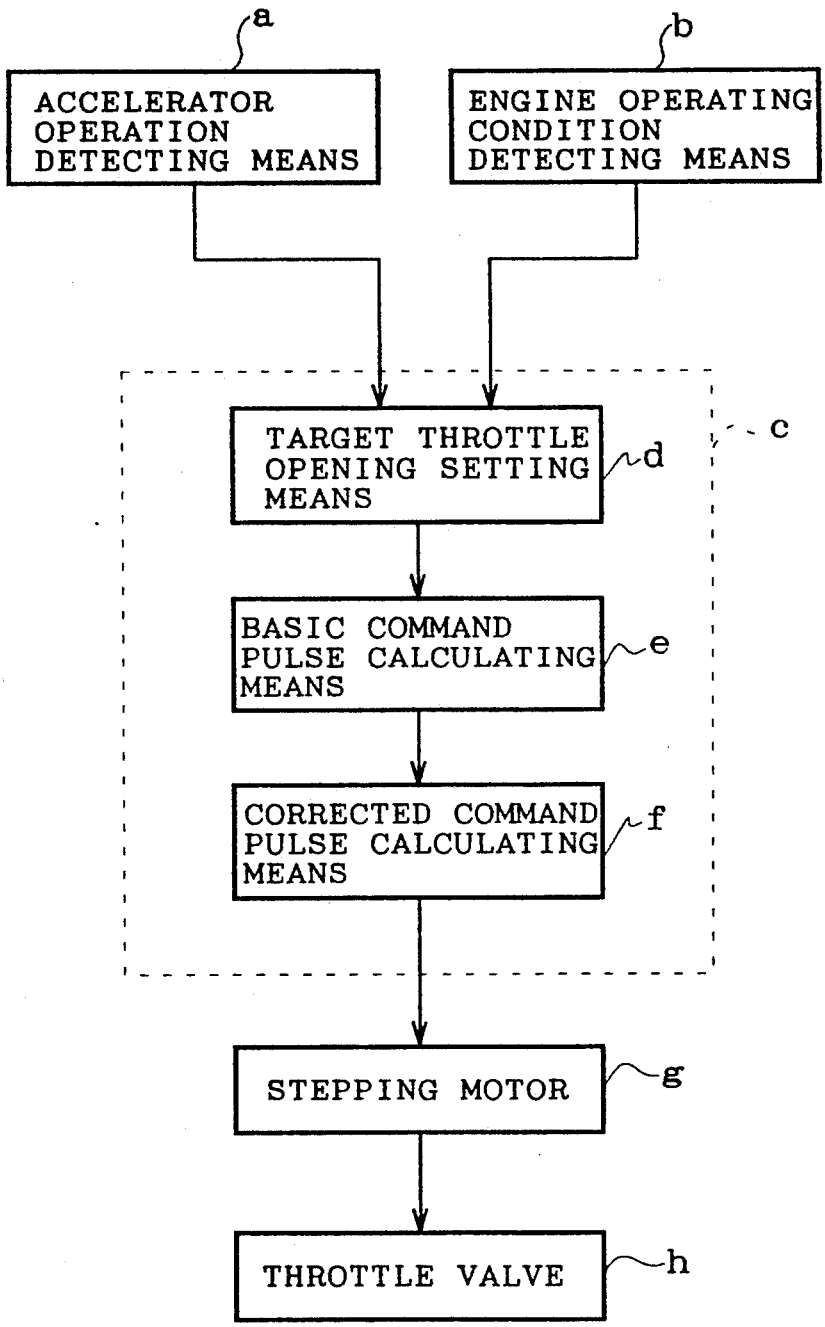
FIG. 1 is a conceptual block diagram of a throttle opening control system according to the present invention.
Figure 2:
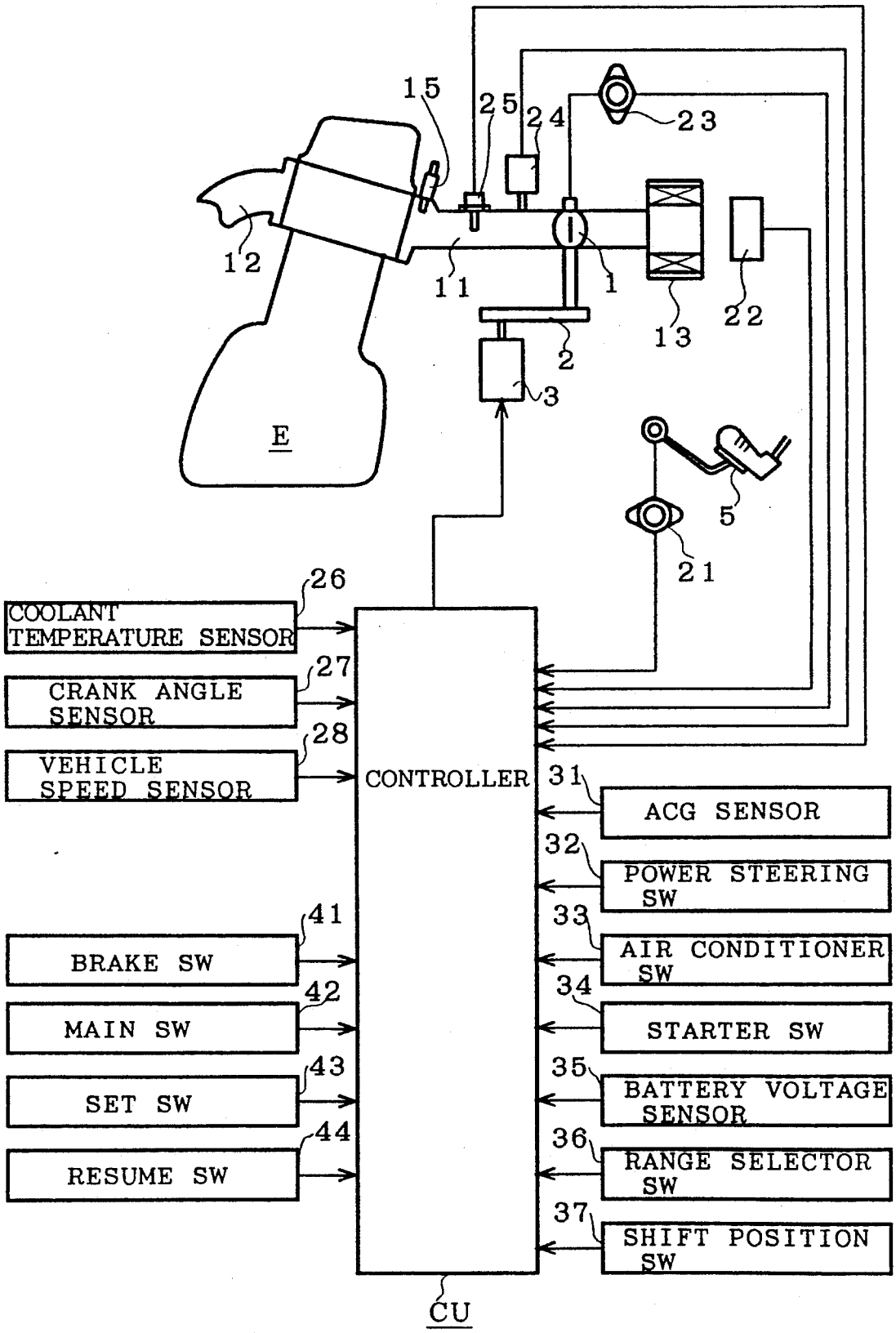
FIG. 2 is a block diagram of the throttle opening control system.

As shown in FIG. 2, a throttle opening control system according to the present invention is used to control the throttle opening of an automotive engine E.

The automotive engine E has an intake passage 11 and an exhaust passage 12 which are connected to a cylinder chamber. An air cleaner 13 is attached to the distal end of the intake passage 11, which has a throttle valve 1 disposed in an intermediate region thereof for controlling the opening through the intake passage 11. A fuel injection valve 15 is mounted in the intake passage 11 near its end close to the cylinder chamber. Air drawn through the air cleaner 13 into the intake passage 11 is regulated by the throttle valve 1. A fuel mist is then supplied from the fuel injection valve 15 to the air flow in the intake passage 11. The air-fuel mixture then flows into the cylinder chamber, in which it is ignited and burned. Exhaust gases are then discharged from the cylinder chamber into the exhaust passage 12.

An accelerator pedal 5, which disposed on the floor before the driver's seat of an automobile, is normally held in an idle position by a spring (not shown). The accelerator pedal 5 can be angularly moved against the bias of the spring when it is operated on, i.e., depressed, by the driver. In the illustrated embodiment, the accelerator pedal 5 and the throttle valve 1 are not mechanically coupled to each other, but electrically connected to each other. A stepping motor 3 is mechanically connected to the throttle valve 1 through a coupling device including a clutch mechanism and a speed reduction gear mechanism. When the stepping motor 3 is energized, it can open and close the throttle valve 1. The stepping motor 3 is electrically controlled depending on the depression of the accelerator pedal 5 and other conditions.

The throttle valve 1 has a return spring (not shown) which normally urges the throttle valve 1 in a fully closing direction at all times. The throttle valve 1 is associated with a throttle sensor 23 comprising a potentiometer for detecting the angular displacement of the throttle valve 1. Therefore, the opening of the throttle valve 1 is detected by the throttle sensor 23.

An intake pressure sensor 24 for detecting the absolute pressure of the intake air is coupled to the intake passage 11 downstream of the throttle valve 1, and an intake temperature sensor 25 for detecting the temperature of the intake air is coupled to the intake passage 11 downstream of the intake pressure sensor 24. An atmospheric pressure sensor 22 for detecting the atmospheric pressure is positioned outside of the intake passage 11. The atmospheric pressure sensor 22 may be positioned in the intake passage 11 upstream of the throttle valve 1.

The accelerator pedal 5 is associated with an accelerator sensor 21 for detecting the amount of operation (the amount of depression) of the accelerator pedal 5. The engine E itself has a coolant temperature sensor 26 for detecting the temperature of an engine coolant and a crank angle sensor 27 for detecting the angular displacement of a distributor to detect a crankshaft angle. A vehicle speed sensor 28 for detecting the speed of the automobile based on the rotational speed of a rotatable member coupled directly to road wheels of the automobile, is associated with a transmission connected to the engine E.

Detected signals from the sensors 21~28 are supplied to a controller CU.

The controller CU is also supplied with output signals from an ACG sensor 31 which detects the field current of an alternator (not shown), a power steering switch 32 which detects whether a power steering system (not shown) operates or not, an air conditioner switch 33 which detects whether an air conditioner (not shown) operates or not, a starter switch 34 which detects whether an engine starter (not shown) operates or not, a battery voltage sensor 35 which detects the voltage of a battery (not shown), a range selector switch 36 which detects the selected range position of a shift lever (not shown), a shift position switch 37 which detects the shift position (gear position) of the shift lever as by referring to a solenoid-emergizing signal of a transmission control unit.

The automobile has an automatic cruise control device having a brake switch 41, a main switch 42, a set switch 43, and a resume switch 44. Output signals from these switches are also supplied to the controller CU.

Figure 3:
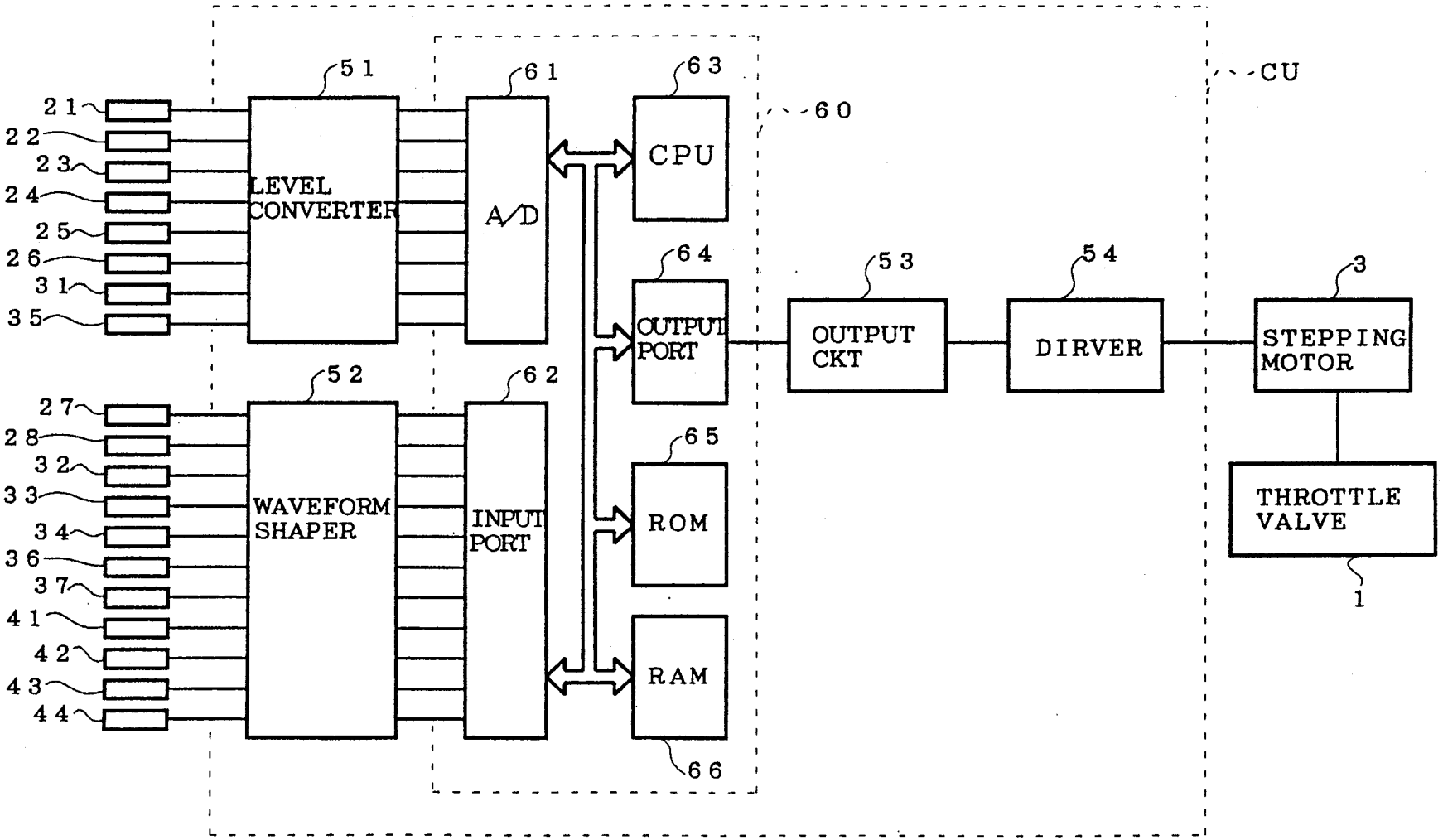
FIG. 3 is a block diagram of a control unit of the throttle opening control system.

The controller CU is shown in detail in FIG. 3.

As shown in FIG. 3, those sensors and switches which are connected to the controller CU and output detected analog signals, i.e., the accelerator sensor 21, the atmospheric pressure sensor 22, the throttle sensor 23, the intake pressure sensor 24, the intake temperature sensor 25, the coolant temperature sensor 26, the ACG sensor 31, and the battery voltage sensor 35, are connected to a level converter 51. The level converter 51 converts the levels of the supplied analog signals into suitable levels. The signals are then applied to a microcomputer 60 in which they are converted by an A/D converter 61 into digital signals that may be temporarily stored in a RAM 66 if necessary.

Those sensors and switches which output digital signals, other than the sensors for generating analog signals, e.g., the crank angle sensor 27, are connected to a waveform shaper 52. The supplied digital signals are shaped in waveform by the waveform shaper 52, and then applied to an input port 62 of the microcomputer 60 in which they may be temporarily stored in the RAM 66 if necessary.

The microcomputer 60 has a CPU 63 for calculating a control value based on the signals from the sensors and switches according to a program stored in a ROM 65, and sends the calculated control value through an output port 64 to an output circuit 53. The output circuit 53 transmits the control value to a driver 54 composed of transistors. In response to the control value, the driver 54 energizes the stepping motor 3 to control the opening of the throttle valve 1, i.e., open and close the throttle valve 1.

The sensors and switches, except the accelerator sensor 21, correspond to the engine operating condition detecting means b, and the microcomputer 60 serves as the target throttle opening setting means d, the basic command pulse calculating means e, and the corrected command pulse calculating means f, i.e., the controller c.

Figure 4:
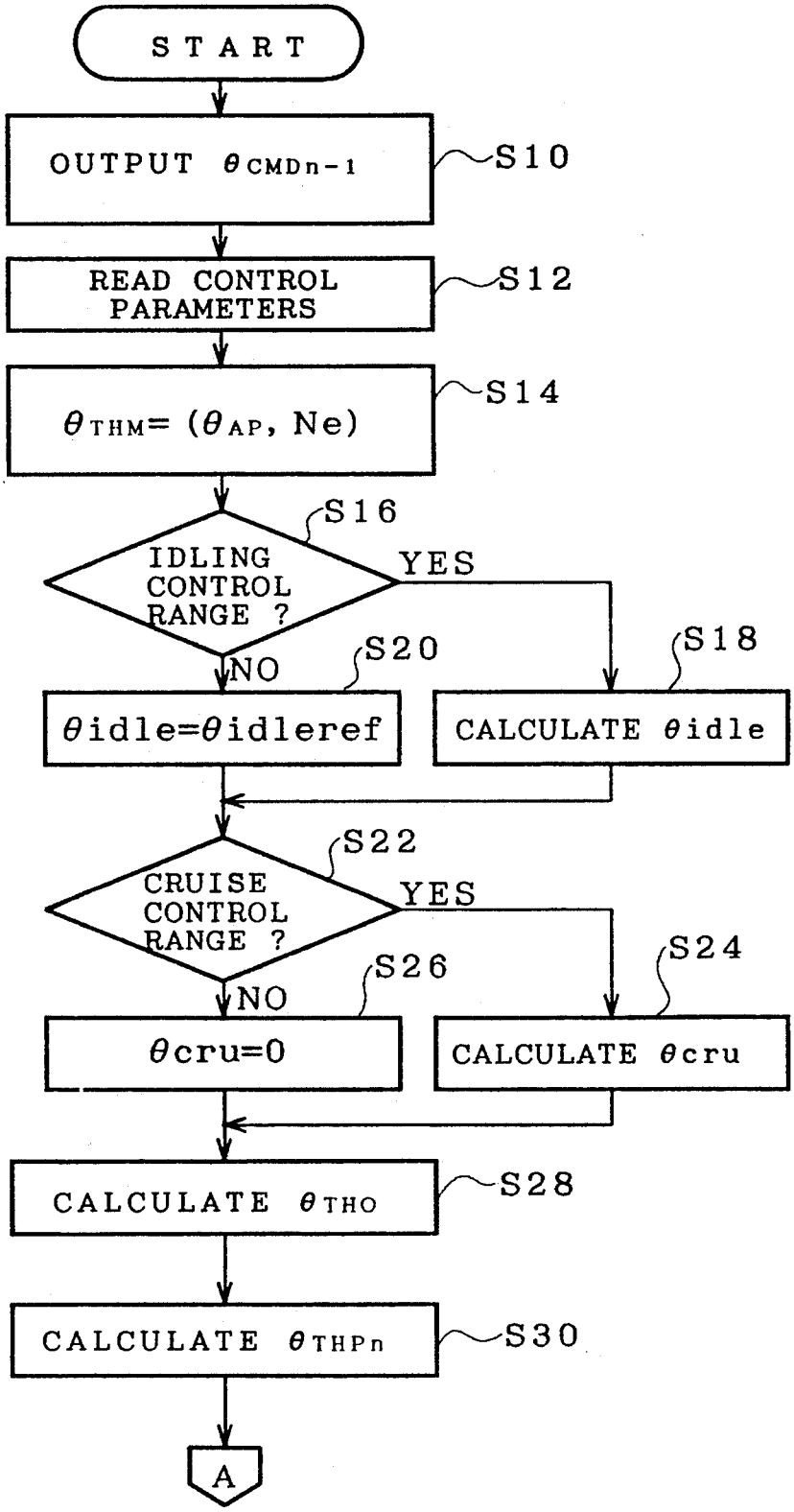
FIGS. 4 through 6 are a flowchart of a control sequence executed by the throttle opening control system.
Figure 5:
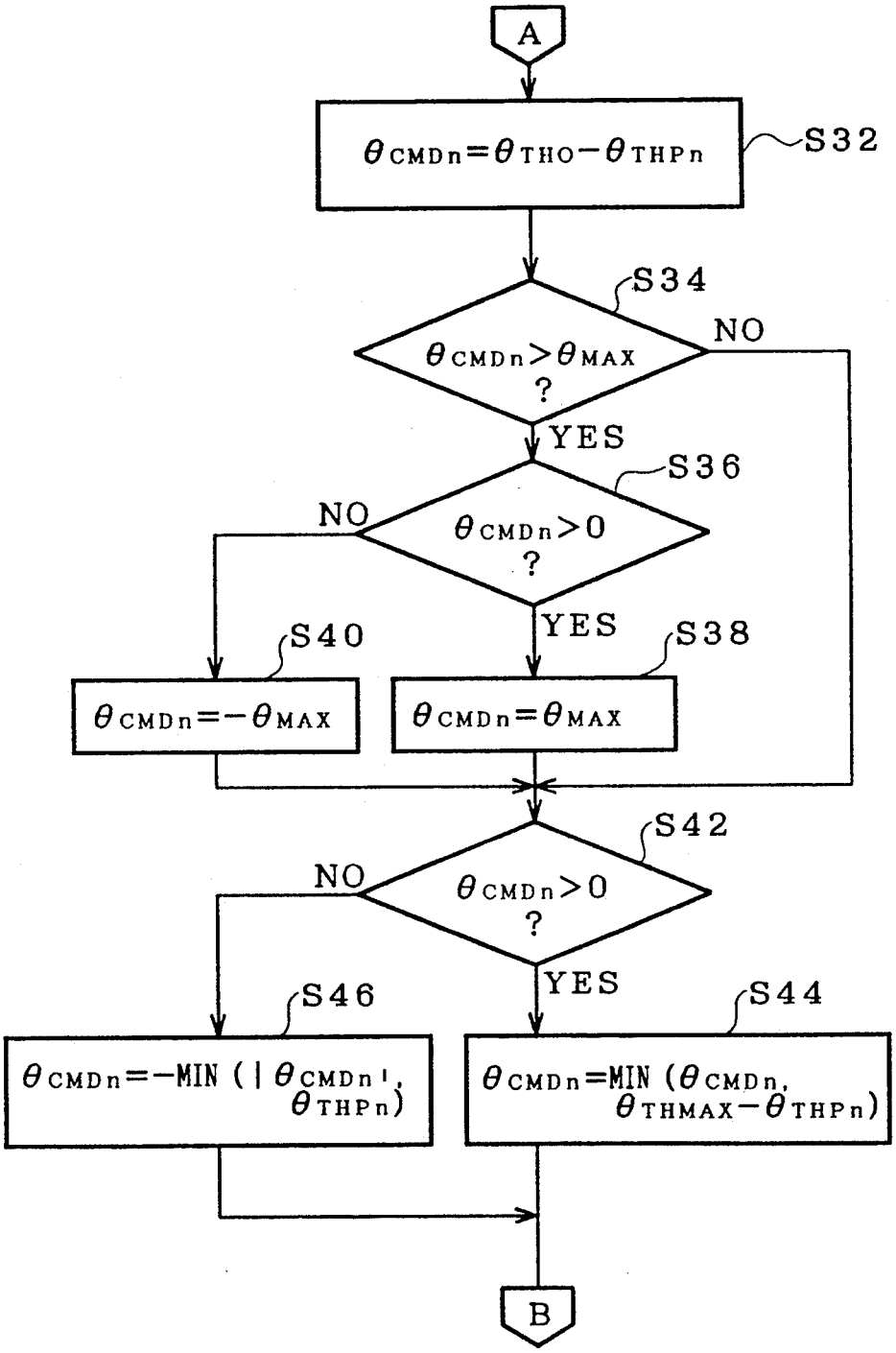
Figure 6:
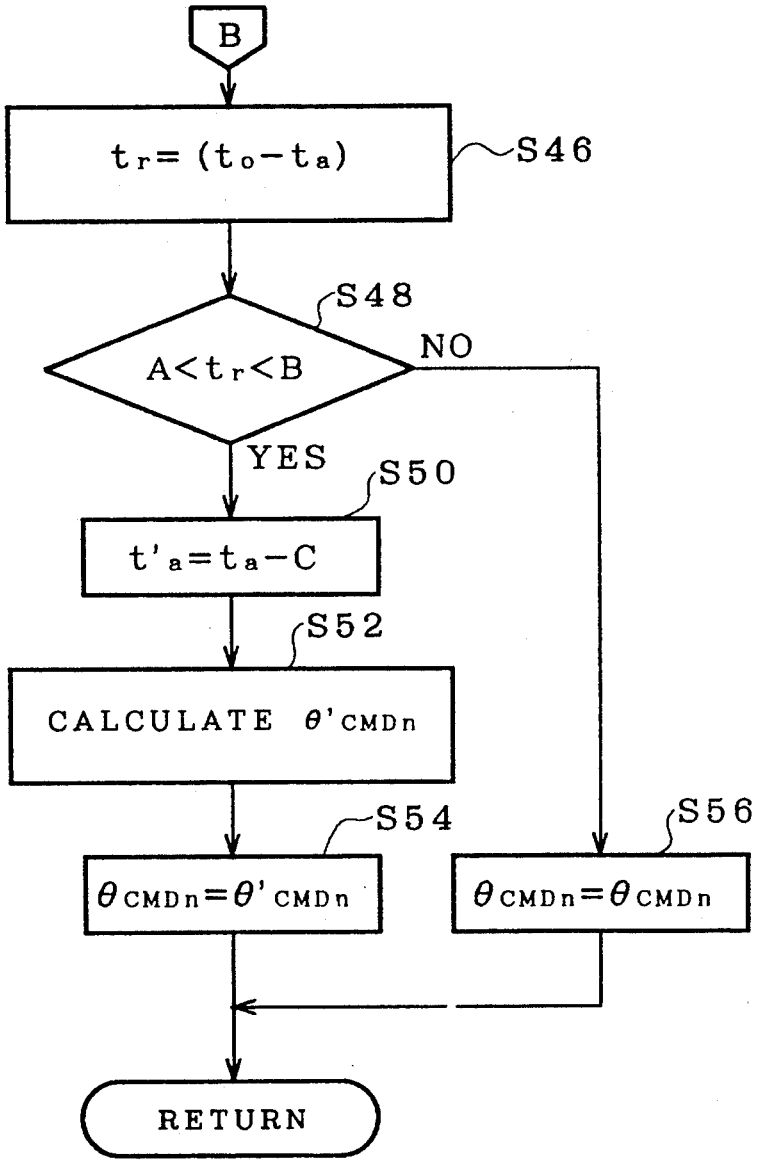

A control sequence of the throttle opening control system will be described below with reference to FIGS. 4 through 6. The program represented by the flowchart shown in FIGS. 4 through 6 is repeated in every predetermined period of time, e.g., of 10 ms.

Figure 7:
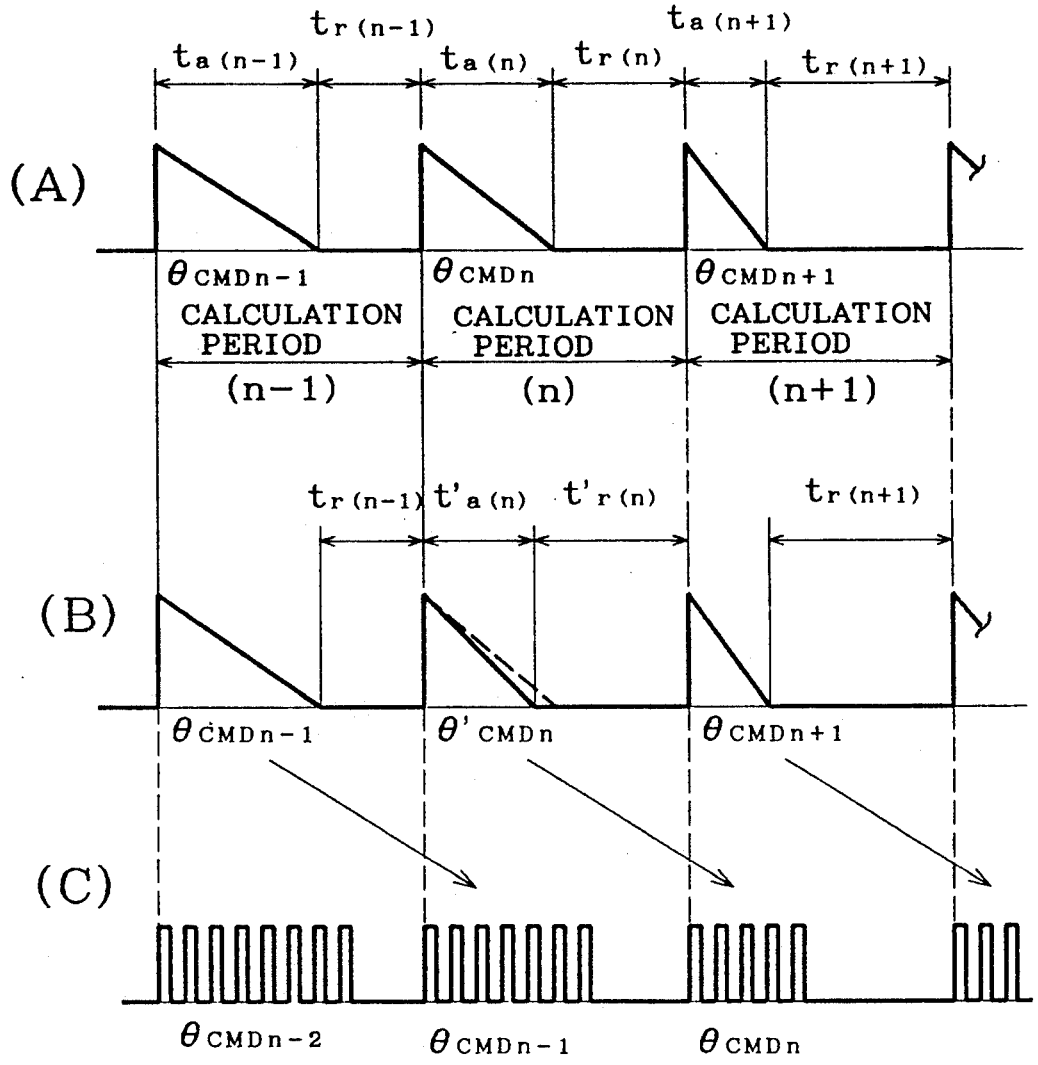
FIGS. 7(A)-(C) are a timing chart showing the manner in which a control value varies in the control sequence.

A previously calculated command value $\theta$ CMDn-1, which is represented by the number of command pulses (angular displacement) is outputted in a step S10. According to the control sequence, calculation periods are relatively short constant periods of 10 ms, as shown in FIG. 7, and a calculated command value is not outputted immediately after it is calculated in a calculation period, but temporarily stored and outputted at an initial stage of a next calculation period.

Then, control parameters including an engine rotational speed Ne, an accelerator opening $\theta$ AP, etc. are successively read and stored in the RAM 66 in a step S12. A reference opening $\theta$ THM for the throttle valve 1 is determined from a map stored in the ROM 65 based on the engine rotational speed Ne and the accelerator opening $\theta$ AP in a step S14.

A step S16 then determines whether the engine E is in an idling control range or not based on a starter switch signal, a range selector signal, an automobile speed, an intake pressure, a throttle opening, and an engine rotational speed. The engine E is in the idling control range when the engine rotational speed is equal to or lower than a preset deceleration rotational speed and equal to or higher than an idling condition determining rotational speed. If the engine E is in the idling control range, then control goes to a step S18 which determines a throttle opening $\theta$ idle for idling control.

If the engine E is not in the idling control range in the step S16, then control goes to a step S20 in which an idling throttle opening $\theta$ idle is set to a predetermined throttle opening $\theta$ idleref. The predetermined throttle opening $\theta$ idleref may, for example, be 10 degrees which is an upper limit of the idling control range (WOT (full throttle opening) =84 degrees).

Thereafter, a step S22 determines whether the engine E is in an automatic cruise control range or not based on output signals from the brake switch 41, the main switch 42, etc. If the engine E is in the automatic cruise control range, then control goes to a step S24 which calculates an automatic cruise throttle opening $\theta$ cru to keep a predetermined vehicle speed. If the engine E is not in the automatic cruise control range, then control proceeds to a step S25 in which the automatic cruise throttle opening is set to zero.

A target throttle opening $\theta$ THO is thereafter calculated in a step S28. Specifically, the maximum value of all the openings calculated so far, i.e., the reference throttle opening $\theta$ THM, the idling throttle opening $\theta$ idle, and the automatic cruise throttle opening $\theta$ cru, is selected as the target throttle opening $\theta$ THO. Since the target throttle opening $\theta$ THO is equal to the maximum value of all the calculated openings, it is possible in the idling control range and the automatic cruise control range, for example, to optimize the throttle opening while permitting these control ranges to be effective together. Inasmuch as the selected maximum value is indicated by a throttle opening, it is divided a predetermined number, i.e., a throttle opening per pulse, for conversion into a number of command pulses.

Then, in a step S30, the previous command value $\theta$ CMDn-1 outputted in the step S10 is added to a previous throttle opening $\theta$ THPn-1 (absolute number of command pulses) to determine a present throttle opening, more precisely, an actual throttle opening $\theta$ THPn. A step S32 calculates the difference between the target throttle opening $\theta$ THO and the actual throttle opening $\theta$ THPn to determine a present basic command value $\theta$ CMDn (change in the number of command pulses).

A step S34 determines whether the absolute value of the present basic command value, irrespective of the direction in which to rotate the stepping motor 3, is larger than an upper limit $\theta$ MAX for the throttle opening. If larger, then a control value is limited to the upper limit $\theta$ MAX depending on the direction in which to rotate the stepping motor 3 in steps S36, S38, S40.

The upper limit $\theta$ MAX is of a value which corresponds to a number of command pulses that can completely be outputted within the calculation period of 10 ms. If command pulses were successively outputted over two or more periods, it would not be possible to accurately calculate the present throttle opening in the step S30. The upper limit θ MAX is employed to avoid such a condition. With the upper limit θ MAX thus used, it is possible to completely output command pulses within a single period, and the present opening can accurately be determined.

Thereafter, the basic command value θ CMDn is checked for its limit in a step S42 to determine whether the throttle valve 1 can be moved as commanded or not. The step S42 checks the basic command value θ CMDn for the direction in which to rotate the throttle valve 1. If the basic command value θ CMDn is indicative of a valve opening direction, then control proceeds to a step S44 that sets a control value in a range over which the throttle valve 1 is movable in the opening direction. Specifically, since the throttle valve 1 cannot be moved in the opening direction beyond the full throttle opening (WOT), the control value is set such that no motor drive command will be outputted to move the throttle valve 1 in the opening direction beyond the full throttle opening.

More specifically, the basic command value θ CMDn is compared with the difference (θ THMAX−θ THPn) between an upper throttle opening limit θ THMAX (absolute number of command pulses) corresponding to the full throttle opening (WOT) and the present throttle opening θ THPn, and the smaller value is selected as the control value. This is done in view of the problem arising out of the spring-loaded throttle valve 1. Specifically, since the throttle valve 1 is normally urged in the fully closing direction by the return spring, when a command value representing a full throttle opening is applied to the stepping motor 3, the stepping motor 3 loses steps at the time the throttle valve 1 abuts against a stopper. The torque of the stepping motor 3 is then lowered, permitting the throttle valve 1 to quickly move to its fully closed position under the bias of the return spring.

If the command value is of a value (negative value) indicative of a valve closing direction, then the absolute value of the command value and the present throttle opening are compared, and the smaller value is selected as a control value in the valve closing direction in a step S46. This is because the present throttle valve opening is of a positive value that is calculated with the fully closed position as being zero.

Since the throttle valve 1 is urged in the fully closing direction by the return spring, no problem would be caused by applying a command to the stepping motor 3 to move the throttle valve 3 in the valve closing direction beyond the fully closed position. However, when no command is applied to the stepping motor 3 to move the throttle valve 3 in the valve closing direction beyond the fully closed position, any command pulses irrespective of operation of the throttle valve 1 are not outputted, and hence the calculation speed and control response of the controller CU are increased.

After the basic command value is set, a corrected command value is calculated.

More specifically, a pulse quiescent time interval tr is calculated in a step S47. As described above, the command values are outputted in each calculation period. Since pulse intervals are determined, the pulse quiescent time interval tr can be determined by subtracting, from the calculation period t0, a time interval ta in which the basic command value θ CMDn is outputted as command pulses (see FIG. 7).

Figure 8:
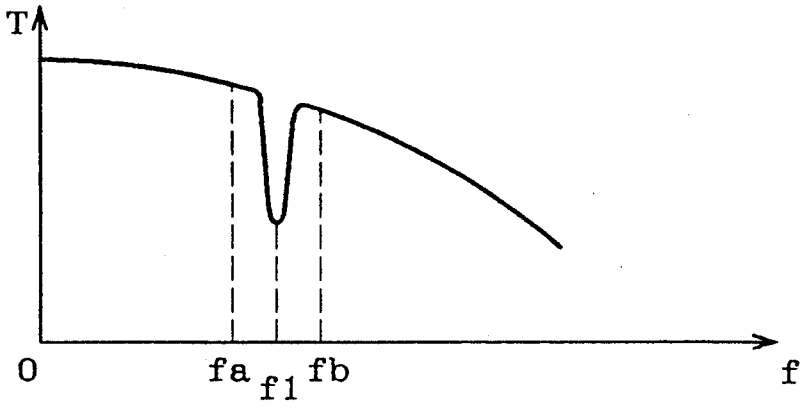
FIG. 8 a graph showing the relationship between the frequency of command pulses applied to a stepping motor and the torque produced by the stepping motor in the control sequence.

Then, a step S48 determines whether the calculated pulse quiescent time interval tr falls within a time range in which the stepping motor 3 loses steps. Since the stepping motor 3 resonates and loses steps at the frequency f1 as shown in FIG. 8, a frequency range extending from a frequency fa across the frequency f1 to a frequency fb is established as an inhibited frequency range. The time range in which the stepping motor 3 loses steps corresponds to the inhibited frequency range fa–fb and is indicated by a range from A to B. Therefore, the step S48 determines whether the calculated pulse quiescent time interval tr falls within the range A–B or not.

If A<tr<B, then since the frequency corresponding to the pulse quiescent time interval tr falls within the inhibited frequency range fa–fb, the stepping motor 3 is liable to lose steps. Control goes to a step S50 which subtracts a time interval C in which to output one pulse from the time interval ta, producing a corrected command pulse output time interval ta'.

Thereafter, a corrected command value θ 'CMDn corresponding to the corrected command pulse output time interval ta' is calculated in a step S52, and replaces the basic command value θ CMDn in a step S54. Using corrected command value θ 'CMDn prevents the stepping motor 3 from losing steps.

If the pulse quiescent time interval tr is not in the range A–B, then since the frequency corresponding to the pulse quiescent time interval tr falls outside the inhibited frequency range fa–fb, the stepping motor 3 is not caused to lose steps by the command value. Consequently, the basic command value θ CMDn is outputted as a corrected command value in a step S56.

The corrected command value calculated in each calculation period in accordance with the above control sequence is outputted at an initial stage of a next calculation period, and the stepping motor 3 is controlled based on the outputted command value in the next calculation period.

Inasmuch as the corrected command value is limited to a value that can fully be outputted within the next calculation period, it is possible to accurately determine the present throttle opening based on the output command pulses.

The pulse quiescent time interval tr is corrected into a value falling outside the time range corresponding to the inhibited frequency range that is established to prevent the stepping motor 3 from losing steps. Consequently, the stepping motor 3 is reliably prevented from losing steps, and can accurately be controlled for controlling the throttle opening.

In the illustrated embodiment, the accelerator pedal 5 and the throttle valve 1 are not mechanically coupled to each other, and the throttle valve 1 is actuated by only the stepping motor 3. However, the throttle opening control system according to the present invention is also applicable to an arrangement in which the accelerator pedal and the throttle valve are mechanically coupled to each other by a wire or the like, and a stepping motor is added to control the throttle valve.

Although a certain preferred embodiment of the present invention has been shown and described in detail, it should be understood that various changes and modifications may be made therein without departing from the scope of the appended claims.

What is claimed is:

1. A control system for controlling the throttle opening of an engine of an automobile, comprising:

a stepping motor for actuating a throttle valve disposed in an intake passage of the engine to control the throttle opening;

accelerator operation detecting means for detecting the amount of operation of accelerator means operated on by the driver of the automobile;

engine operating condition detecting means for detecting an operating condition of said engine;

a controller for controlling said stepping motor based on detected values from said accelerator operation detecting means and said engine operating condition detecting means;

said controller comprising:

target throttle opening setting means for setting a target throttle opening for the engine based on the detected values from said accelerator operation detecting means and said engine operating condition detecting means;

basic command pulse calculating means for calculating, in each periodic calculation period used by the controller, command pulses to be applied to the stepping motor which are required to equalize an actual throttle opening with said target throttle opening;

corrected command pulse calculating means for calculating a pulse quiescent time interval from the completion of outputting of calculated command pulses which have been outputted from the start of a next calculation period, to the end of the calculation period, and correcting the command pulses such that if the calculated pulse quiescent time interval is of a value within a predetermined time range in which said stepping motor would lose steps, then the calculated pulse quiescent time interval is corrected into a value outside said predetermined time range; and means for outputting the command pulses corrected by said corrected command pulse calculating means and determined in each calculation period at an initial stage of each calculation period to control said stepping motor for controlling the throttle opening.

2. A control system according to claim 1, wherein said basic command pulse calculating means comprises means for preventing command pulses to be set beyond an upper limit represented by a maximum number of command pulses that can completely be outputted within said each calculation period.

3. A control system according to claim 1, wherein said basic command pulse calculating means comprises means for preventing command pulses to be set as a drive command to open said throttle valve beyond a fully open position and a drive command to close said throttle valve beyond a fully closed position.

4. A control system according to claim 1, wherein said corrected command pulse calculating means comprises means for subtracting a time (ta) in which to output said command pulses from said calculation period (t0) thereby to determine said pulse quiescent time interval (tr), and correcting said command pulses such that said pulse quiescent time interval (tr) is corrected into a value outside of a time range which corresponds to an inhibited frequency range of said stepping motor when said pulse quiescent time interval (tr) falls within said time range.

5. A control system according to claim 4, wherein said corrected command pulse calculating means comprises means for reducing the number of command pulses by one when said pulse quiescent time interval (tr) falls in the time range corresponding to said inhibited frequency range of said stepping motor.

6. A control system according to any one claims 1 through 3, wherein said controller comprises means for setting an idling throttle opening ($\theta$ idle) when said engine is determined as being in an idling control range by said engine operating condition detecting means, setting an automatic cruise throttle opening ($\theta$ cru) when said engine is determined as being in an automatic cruise control range by said engine operating condition detecting means, and setting a reference throttle opening ($\theta$ THM) corresponding to a throttle opening and an engine rotational speed at the time when said engine is determined as not being in the idling control range or the automatic cruise control range by said engine operating condition detecting means, and wherein said target throttle opening setting means comprises means for setting a maximum one of said idling throttle opening ($\theta$ idle), said automatic cruise throttle opening ($\theta$ cru), and said reference throttle opening ($\theta$ THM) as said target throttle opening.

* * * * *